US008168273B2

(12) United States Patent
Tomosue et al.

(10) Patent No.: US 8,168,273 B2
(45) Date of Patent: May 1, 2012

(54) HOLDING MATERIAL FOR CATALYTIC CONVERTER

(75) Inventors: Nobuya Tomosue, Shizuoka (JP); Tadashi Sakane, Shizuoka (JP)

(73) Assignee: Nichias Corporation, Tokyo (JP)

( * ) Notice: Subject to any disclaimer, the term of this patent is extended or adjusted under 35 U.S.C. 154(b) by 615 days.

(21) Appl. No.: 12/222,431

(22) Filed: Aug. 8, 2008

(65) Prior Publication Data

US 2009/0041967 A1 Feb. 12, 2009

(30) Foreign Application Priority Data

Aug. 10, 2007 (JP) ..... P. 2007-209011

(51) Int. Cl.

| | |
|---|---|
| ***B32B 1/08*** | (2006.01) |
| ***F16L 9/10*** | (2006.01) |
| ***F16L 11/04*** | (2006.01) |
| ***F16L 11/08*** | (2006.01) |

(52) U.S. Cl. ..... 428/34.5; 428/34.6; 428/34.7; 428/35.7; 428/36.1; 428/36.2; 428/36.8; 428/36.91

(58) Field of Classification Search ..... 428/34.1–34.7, 428/35.7, 36.1, 36.2, 36.8, 36.9, 36.91, 36.92
See application file for complete search history.

(56) References Cited

U.S. PATENT DOCUMENTS

| | | | | |
|---|---|---|---|---|
| 7,550,117 | B2 * | 6/2009 | Alward et al. | 422/177 |
| 2006/0278323 | A1 | 12/2006 | Eguchi | |

FOREIGN PATENT DOCUMENTS

| | | | |
|---|---|---|---|
| CN | 1876748 | A | 12/2006 |
| EP | 0 765 993 | A1 | 4/1997 |
| EP | 1 731 729 | A1 | 12/2006 |
| GB | 1 604 908 | | 12/1981 |
| JP | 8-061054 | | 3/1996 |
| JP | 2001-32710 | | 2/2001 |
| WO | WO 2007/030410 | A1 | 3/2007 |

OTHER PUBLICATIONS

Notification of the First Office Action and English translation in CN 200810135485.X dated Jul. 13, 2011.
Examination Report in GB 0814478.4 issued May 17, 2011.
Office Action (and English translation) in JP 2007-209011 mailed Oct. 4, 2011.

* cited by examiner

*Primary Examiner* — Walter B Aughenbaugh
(74) *Attorney, Agent, or Firm* — Nixon & Vanderhye P.C

(57) ABSTRACT

The present invention relates to a holding material for a catalytic converter including a catalyst carrier, a metal casing for receiving the catalyst carrier, and the holding material wound around the catalyst carrier and interposed in a gap between the catalyst carrier and the metal casing, in which the holding material includes an inorganic fiber substrate and a viscoelastic layer formed at least on a casing side surface of the inorganic fiber substrate and having a Young's modulus at 25° C. of 0.3 MPa or less.

7 Claims, 4 Drawing Sheets

(A)

(PRIOR ART)

(B)

(PRIOR ART)

HOLDING MATERIAL FOR CATALYTIC CONVERTER

FIELD OF THE INVENTION

The present invention relates to a holding material for a catalytic converter for holding in a metal casing a catalyst carrier incorporated in a catalytic converter (also referred to as an exhaust gas purifying apparatus) for removing particulates, carbon monoxide, hydrocarbons, nitrogen oxides and the like contained in exhaust gas discharged from an internal combustion engine such as a gasoline engine or a diesel engine, and a production method thereof.

BACKGROUND OF THE INVENTION

As is well known, catalytic converters for purifying exhaust gas are mounted on vehicles such as automobiles, in order to remove harmful components such as carbon monoxide, hydrocarbons, nitrogen oxides contained in exhaust gas from engines thereof. FIG. 1 is a cross-sectional view schematically showing an embodiment of a catalytic converter. In this catalytic converter 10, an introduction pipe 16 through which exhaust gas discharged from an internal combustion engine is introduced is connected to one end of a metal casing 11, and a discharge pipe 17 through which the exhaust gas which has passed through a catalyst carrier 12 is discharged outside is attached to the other end thereof. Further, the catalyst carrier 12 is provided inside the metal casing 11 with the intervention of a holding material 13 for a catalyst converter.

Furthermore, an electric heater and a temperature sensor for burning particulates accumulated in the catalyst carrier, namely a honeycomb filter, to recover a filtering function (also referred to as regeneration treatment) may be provided on an exhaust gas introduction side (also referred to as a suction side) with respect to a catalyst carrier, and another pipe for feeding combustion air may be connected thereto, although not shown in the figure. According to such constitution, when the amount of the particulates accumulated in the catalyst carrier 12 increases to result in an increase in pressure drop, the regeneration treatment can be conducted.

The metal casing 11 can be constituted as to divide a cylindrical body into two parts along a longitudinal direction thereof, as shown in FIG. 2. The catalyst carrier 12 around which the holding material 13 for a catalyst converter has been wound is located at a predetermined position in a lower shell 22*b*, and an upper shell 22*a* is placed on the lower shell 22*b* so that a through hole 23*a* formed in an upper fixing portion 23 is exactly superimposed on a through hole 24*a* formed in a lower fixing portion 24. A bolt 25 is inserted through the through holes 23*a* and 24*a*, and fixed by a nut or the like.

Alternatively, the upper fixing portion 23 and the lower fixing portion 24 may be welded with each other. Further, the metal casing 11 may be a cylindrical body 30 as shown in FIG. 3. Although this requires no assembling work necessary for the metal casing having the two-divided structure as shown in FIG. 2, it is necessary to press the catalyst carrier 12 around which the holding material 13 for a catalytic converter has been wound into the cylindrical body from an opening 31 thereof.

The catalyst carrier 12 is generally a cylindrical honeycomb-like formed article made of, for example, cordierite or the like, on which a noble metal catalyst or the like is carried. It is therefore necessary that the holding material 13 for a catalytic converter has a function of safely holding the catalyst carrier 12 so that the catalyst carrier 12 is not damaged by collision with the metal casing due to vibration or the like during running of the automobile, as well as a function of performing sealing so that unpurified exhaust gas does not leak out through a gap between the catalyst carrier 12 and the metal casing 11. Consequently, at present, as the holding material, there has been mainly used a holding material obtained by forming inorganic fibers such as alumina fibers, mullite fibers or other ceramic fibers into a mat shape having a predetermined thickness using an organic binder. Further, the shape thereof is a planar shape shown in FIG. 4 (A). A convex portion 42 is formed on one end of a tabular main body portion 41, and a concave portion 43 having a shape fittable with the shape of the convex portion 42 is formed on the other end. Then, as shown in FIG. 4(B), the main body portion 41 is wound around an outer peripheral surface of the catalyst carrier 12, and the convex portion 42 and the concave portion 43 are engaged with each other, thereby winding the holding material 13 for a catalyst converter around the catalyst carrier 12.

Examples of generally used organic binder include a rubber, a water-soluble organic polymer compound, a thermoplastic resin, a thermosetting resin and the like. Further, when the holding material 13 for a catalytic converter is too thick, a winding operation around the catalyst carrier 12 and a mounting operation in the metal casing 11 becomes difficult. Therefore, it is necessary to make the holding material thin to some degree. Accordingly, in the general holding materials, these organic binders are used in an amount of 5 to 8% by mass based on the total amount of the holding material, and in an amount of about 10% by mass when used in large amount.

However, recently, the catalyst carrier 12 is heated to nearly 1,000° C. in order to enhance purifying efficiency, so that the above-mentioned organic binder is easily decomposed and burnt down to generate various organic gases such as $CO_2$ and CO. In particular, these gases are generated in large amounts in an early stage of actuation of the catalytic converter. The exhaust gas regulation becomes more and more severe, so that there is a possibility of exceeding a specified value by $CO_2$ and the like derived from the organic binder. Further, recently, although electronic control of engines has progressed, the existence of $CO_2$ independent of the original exhaust gas causes sensors of an exhaust system to produce improper operating signals to adversely affect the electronic control of engines. In order to prevent such a problem, manufacturers conduct burning treatment before shipment to burn down the organic binders. Such burning treatment lays a substantial burden on the makers, and poses an important problem.

It is also conceivable to decrease the amount of organic binder used. However, binding force of the inorganic fibers is weakened by the decreased amount to make the holding material 13 for a catalytic converter thick, which causes a problem of deteriorating assembling properties. Further, problems such as a decrease in strength and an increase in friction coefficient of a casing side surface of the holding material 13 for a catalytic converter are also conceivable by a decrease in organic binder. It has been therefore performed that a surface protective layer such as a film, a tape, a nonwoven fabric or resin coating is provided on the casing side surface of the holding material 13 for a catalytic converter (see JP-A-2001-32710 and JP-A-8-61054). However, the surface protective layer is formed in an amount of 15 g/m$^2$ or more. Accordingly, the organic content exceeds 1% by mass based on the total amount of the holding material only by providing it on the surface. When it is tried to decrease the mass of the protective layer, the strength of the protective layer decreases. Accordingly, trouble such as the occurrence of cracks or breakage in the protective layer occurs in winding.

SUMMARY OF THE INVENTION

The invention has been made in view of such a situation, and an object thereof is to provide a holding material for a catalytic converter which can surely inhibit the occurrence of cracks or breakage in winding it around a catalyst carrier, although the organic content thereof is smaller than that of a conventional one.

In order to achieve the above-mentioned object, the invention provides the following holding materials for a catalytic converter:

(1) A holding material for a catalytic converter provided with a catalyst carrier, a metal casing for receiving the catalyst carrier, and the holding material wound around the catalyst carrier and interposed in a gap between the catalyst carrier and the metal casing, wherein the holding material comprises an inorganic fiber substrate and a viscoelastic layer formed at least on a casing side surface of the substrate and having a Young's modulus at 25° C. of 0.3 MPa or less;

(2) The holding material according to (1), wherein the viscoelastic layer comprises at least one of (A) a rubber to which a tackifier is added and (B) a resin having a glass transition point of 25° C. or less;

(3) The holding material according to (1) or (2), further comprising a smooth layer formed on a surface of the viscoelastic layer and having a friction coefficient of 0.1 to 0.5;

(4) The holding material according to any one of (1) to (3), wherein the viscoelastic layer contains organic components in an amount of 2.5 g/m$^2$ or less;

(5) The holding material according to (3) or (4), wherein the smooth layer contains organic components in an amount of 2.5 g/m$^2$ or less;

(6) The holding material according to any one of (3) to (5), wherein the smooth layer is a synthetic resin film having a thickness of 5 μm or less; and (7) The holding material according to any one of (1) to (6), wherein the total organic content is 1.5% or less by mass based on the total mass of the holding material.

In the holding material for a catalytic converter of the invention, the viscoelastic layer corresponds to the protective layer, and although the organic content thereof is smaller than that of the conventional protective layer, the occurrence of cracks or breakage in winding it around the catalyst carrier can be more surely prevented. Further, when the smooth layer is additionally provided, press fitting into the cylindrical metal casing can be easily performed, and the assembling work necessary for the metal casing having the two-divided structure becomes unnecessary, which can make simple the production process of the catalytic converter.

DESCRIPTION OF REFERENCE NUMERALS AND SIGNS

11 Metal Casing
12 Catalyst Carrier
13 Holding Material for Catalytic Converter

DETAILED DESCRIPTION OF THE INVENTION

The invention will be described in detail below.

The holding material for a catalytic converter of the invention comprises an inorganic fiber substrate and a viscoelastic layer formed thereon.

There is no restriction on the substrate. Examples of the substrates include: mat materials such as a compressed mat obtained by forming inorganic fibers and an organic binder in a wet system, and then drying under a compressed state; a mat comprising a blanket obtained by needling collected inorganic fibers; and an expanded mat obtained by forming inorganic fibers and an expanding material such as vermiculite in a wet system.

Figure 4:
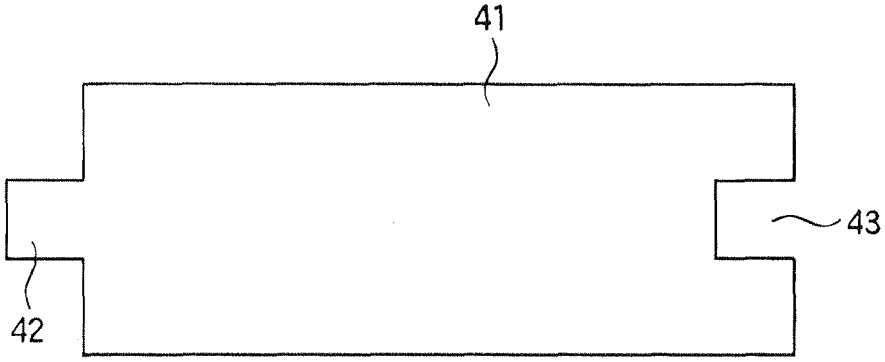
FIG. 4(A) is a plan view showing a holding material for a catalytic converter.
FIG. 4(B) is a perspective view showing a state where the holding material is wound around a catalyst carrier.
Figure 4:
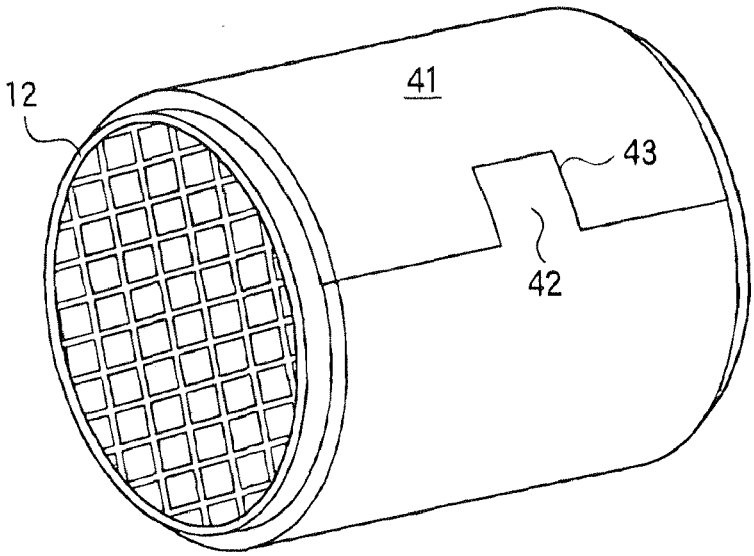

Further, there is no restriction on the overall shape. For example, as shown in FIG. 4(A), it can be a shape in which a convex portion 42 is formed on one end of a tabular main body portion 41, and a concave portion 43 having a shape fittable in the convex portion 42 is formed on the other end. The shape of the convex portion 42 and the concave portion 43 may be triangular or semicircular, as well as the rectangular shape shown in the drawing. Further, the number of the convex portion 42 and the concave portion 43 is not limited to one, and may be two or more.

As the inorganic fibers, various inorganic fibers which have hitherto been used in holding materials can be used. For example, alumina fiber, mullite fiber and other ceramic fibers can be appropriately used. More specifically, as the alumina fiber, for example, one containing 90% or more by weight of $Al_2O_3$ (the remainder is $SiO_2$) and having low crystallinity in terms of X-ray crystallography is preferred. Specifically, the crystallinity of the alumina fiber is 30% or less, preferably 15% or less, more preferably, 10% or less. Further, the fiber diameter thereof is preferably from 3 to 15 μm, or 3 to 7 μm, and the wet volume thereof is preferably 400 cc/5 g or more. As the mullite fiber, for example, one having a mullite composition in which the weight ratio of $Al_2O_3/SiO_2$ is about 72/28 to 80/20 and having low crystallinity in terms of X-ray crystallography is preferred. Specifically, the crystallinity of the mullite fiber is 30% or less, preferably 15% or less, more preferably, 10% or less. Further, the fiber diameter thereof is preferably from 3 to 15 μm, or 3 to 7 μm, and the wet volume thereof is preferably 400 cc/5 g. Examples of the other ceramic fibers include silica alumina fiber and silica fiber, and all of them may be ones which have hitherto been used in holding materials. Further, glass fiber, rock wool or biodegradable fiber may be incorporated therein.

The above-mentioned wet volume is calculated by the following method having the following steps:

(1) 5 grams of a dried fiber material is weighed by weigher with accuracy of two or more decimal places;

(2) The weighed fiber material is placed in a 500 g glass beaker;

(3) About 400 cc of distilled water having a temperature of 20 to 25° C. is poured into the glass beaker prepared in the step (2), and stirring is carefully performed by using a stirrer so as not to cut the fiber material, thereby dispersing the fiber material. For this dispersion, an ultrasonic cleaner may be used;

(4) The content of the glass beaker prepared in the step (3) is transferred into a 1,000 ml graduated measuring cylinder, and distilled water is added thereto up to the scale of 1,000 cc;

(5) Stirring of the graduated measuring cylinder prepared in the step (4) is performed by turning the cylinder upside down while blocking an opening of the graduated measuring cylinder with the palm of a hand carefully to prevent water from leaking out. This procedure is repeated 10 times in total;

(6) the sedimentation volume of fiber is measured by visual observation after placing the graduated measuring cylinder quietly under room temperature for 30 minutes after the stop of the stirring; and (7) The above-mentioned operation is performed for 3 samples, and an average value thereof is taken as a measured value.

As the organic binder, conventional organic binders such as a rubber, a water-soluble organic polymer compound, a thermoplastic resin, a thermosetting resin or the like can be used. Specific examples of the rubbers include a copolymer of n-butyl acrylate and acrylonitrile, a copolymer of ethyl acrylate and acrylonitrile, a copolymer of butadiene and acrylonitrile, butadiene rubber and the like. Examples of the water-soluble organic polymer compounds include carboxymethyl cellulose, polyvinyl alcohol and the like. Examples of the thermoplastic resins include a homopolymer and a copolymer of acrylic acid, an acrylic ester, acrylamide, acrylonitrile, methacrylic acid, a methacrylic ester or the like, an acrylonitrile-styrene copolymer, an acrylonitrile-butadiene-styrene copolymer and the like. Examples of the thermosetting resins include a bisphenol type epoxy resin, a novolac type epoxy resin and the like.

These organic binders can also be used as a combination of two or more thereof. There is no restriction on the amount of the organic binder used, as long as it is such an amount that the inorganic fibers can be bound, and it is from 0.1 to 12 parts by mass based on 100 parts by mass of the inorganic fibers. When the amount of the organic binder is less than 0.1 parts by mass, the binding force is insufficient. In the case of exceeding 10 parts by mass, the amount of the inorganic fibers relatively decreases to fail to obtain necessary holding performance and sealing performance. The amount of the organic binder is preferably from 0.2 to 10 parts by mass, and more preferably from 0.2 to less than 6 parts by mass.

Further, it is also possible to incorporate organic fibers such as pulp in the substrate in small amounts as the organic binder. The thinner and longer organic fibers have the higher binding force, so that highly fibrillated cellulose, cellulose nanofiber or the like is preferred. Specifically, the fiber diameter is preferably from 0.01 to 50 μm, and the fiber length is preferably from 1 to 5,000 μm. More preferably, the fiber diameter is from 0.02 to 1 μm, and the fiber length is from 10 to 1,000 μm.

There is no restriction on the amount of such fibrillated fibers used, as long as it is such an amount that the inorganic fibers can be bound, and it is from 0.1 to 5 parts by mass based on 100 parts by mass of the inorganic fibers. When the amount of the fibrillated fibers is less than 0.1 part by mass, the binding force is insufficient. In the case of exceeding 5 parts by mass, the amount of the inorganic fibers relatively decreases to fail to obtain necessary holding performance and sealing performance. The amount of the fibrillated fibers is preferably from 0.1 to 2.5 parts by mass, and more preferably from 0.1 to less than 1 part by mass.

Such fibrillated fibers may be used in combination with an inorganic binder. According to the simultaneous use of the fibrillated fibers and the inorganic binder, even when the amount of the fibrillated fibers used is decreased in order to avoid the above-mentioned problem caused by volatilization of organic components at the time of use, the inorganic fibers can be well bound to be able to provide the holding material for a catalytic converter having a thickness equivalent to that of a conventional holding material. As the inorganic binder, conventional inorganic binder can be used. Examples thereof include glass frit, colloidal silica, alumina sol, silicate soda, titania sol, lithium silicate, water glass and the like. These inorganic binders can also be used as a combination of two or more thereof. There is no restriction on the amount of the inorganic binder used, as long as it is such an amount that the inorganic fibers can be bound, and it is from 0.1 to 10 parts by mass based on 100 parts by mass of the inorganic fibers. When the amount of the inorganic binder is less than 0.1 parts by mass, the binding force is insufficient. In the case of exceeding 5 parts by mass, the amount of the inorganic fibers relatively decreases to fail to obtain necessary holding performance and sealing performance. The amount of the inorganic binder is preferably from 0.2 to 6 parts by mass, and more preferably from 0.2 to less than 4 parts by mass.

As for the viscoelastic layer, there is no restriction on the material thereof, as long as it has a Young's modulus at 25° C. of 0.3 MPa or less, preferably 0.2 MPa or less. However, the material is preferably at least one of (A) a rubber to which a tackifier is added and (B) a resin having a glass transition point of 25° C. or less.

Specifically, in (A), the rubber is preferably a natural rubber containing polyisoprene as a main component, or a synthetic rubber such as SBR, butyl rubber, nitrile rubber or silicone rubber. The tackifier is preferably an oligomer having a molecular weight of several thousands. For example, an oligomer of rosin, terpene, a petroleum resin or the like is suitable. Further, the amount of the tackifier blended is preferably from 40 to 300 parts by mass based on 100 parts by mass of the rubber. When the amount of the tackifier blended is less than 40 parts by mass, the desired elongation cannot be realized.

Further, as (B), an acrylic resin containing an acrylic ester or a methacrylic ester as a main component, EVA, polyvinyl ether or the like is suitable. The winding operation of the holding material around the catalyst carrier is usually performed at room temperature. Accordingly, when the resin has a glass transition point exceeding 25° C., the holding material becomes too hard at the time of the winding operation, resulting in the difficulty to obtain the above-mentioned Young's modulus. Therefore, it is preferred that the resin has a lower glass transition point, and the glass transition point is preferably from −50° C. to 25° C. In order to obtain elasticity, it is preferred that the resin is not crosslinked. However, when a crosslinking agent is incorporated, it is necessary to control the degree of crosslinking by heating conditions in a drying process and the like to perform adjustment to the above-mentioned Young's modulus. As the crosslinking agent, melamine, an epoxy compound, a urea resin or the like can be used, and it is preferably added in an amount of 1 to 40 parts by mass based on 100 parts by mass of the resin.

The Young's modulus can be determined based on JIS K6251 (Tensile Test Method of Vulcanized Rubber) from the following equation (1):

$$\text{Young's modulus } (Y)=M/E \quad (1)$$

wherein E is the breaking elongation (%), and when the initial length of a test piece is taken as L0 (mm) and the length of the test piece at the time of breakage as L1 (mm), it can be determined from the following equation (2):

$$\text{Breaking elongation } (E)=[(L1-L0)/L0]\times 100 \quad (2)$$

Further, M is the tensile stress (MPa), and when the tensile tension at the time of breakage is taken as F (N) and the cross-sectional area of the test piece as A ($mm^2$), it can be determined from the following equation (3):

$$\text{Tensile stress } (M)=F/A \quad (3)$$

The above-mentioned equation (1) reveals that an increase in breaking elongation (E) results in a decrease in Young's modulus. In the invention, the breaking elongation of the viscoelastic layer is preferably 300% or more. When the holding material is wound around the catalyst carrier, a casing side surface thereof is largely stretched in a circumferential direction. Accordingly, cracks and breakage can be prevented by increasing the elongation of the viscoelastic layer disposed on the casing side.

As a method for forming the viscoelastic layer, applying the above-mentioned rubber material or resin material onto the substrate, followed by drying may be mentioned. Although there is no restriction on a coating method, brush coating or roll coating is preferred because of its viscosity. Further, when the substrate is the compressed mat or expanded mat obtained by wet forming, it is also possible to apply the rubber material or the resin material onto the mat in a state where the mat is formed by dehydration, namely, in a cake state, followed by drying the whole.

Figure 1:
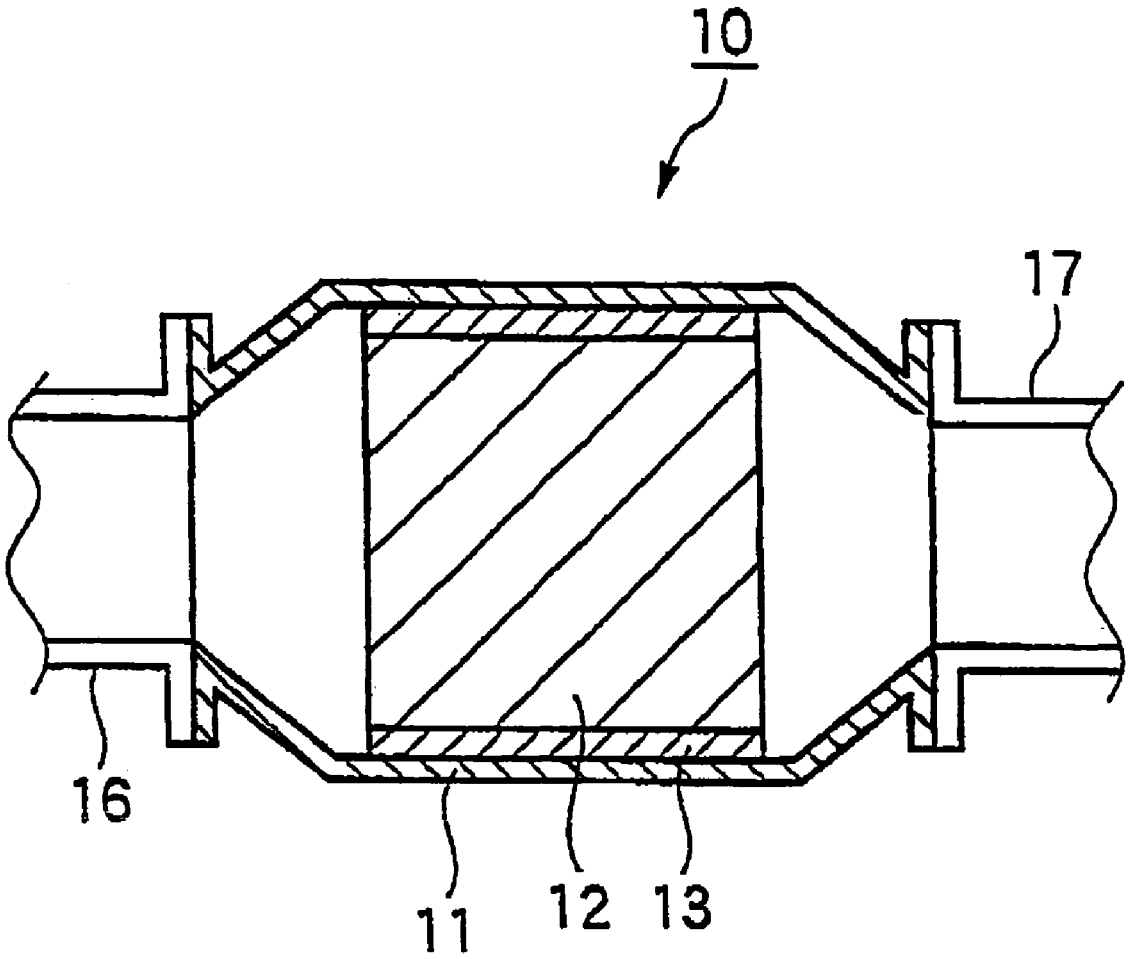
FIG. 1 is a cross-sectional view showing an embodiment of a catalytic converter.
Figure 2:
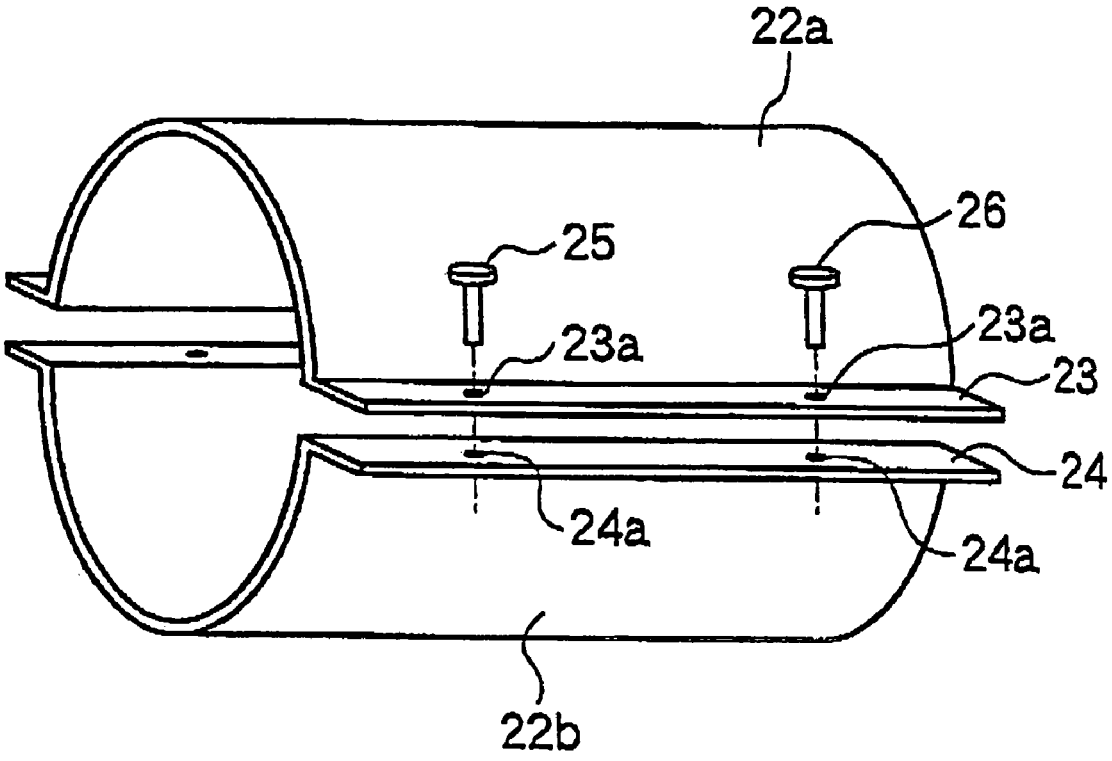
FIG. 2 is an exploded view showing an embodiment of a metal casing.
Figure 3:
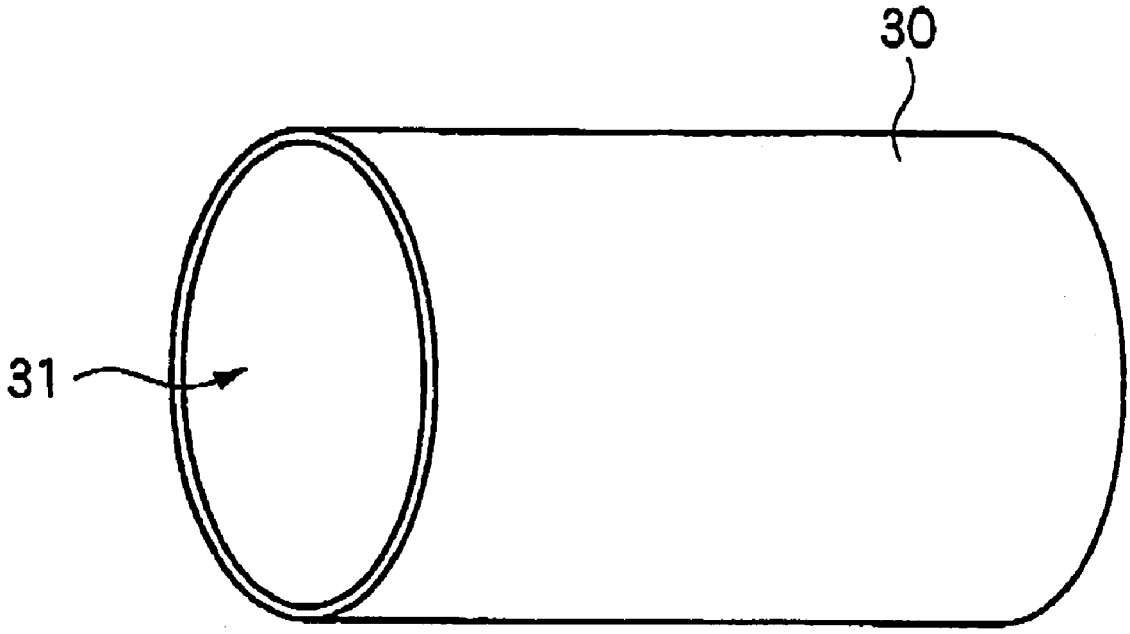
FIG. 3 is a perspective view showing another embodiment of a metal casing.

Since the above-mentioned viscoelastic layer is sticky, it is preferred to cover a surface thereof with a smooth layer comprising a low friction material, in terms of handling properties and increased frictional resistance in pressing it into the cylindrical metal casing shown in FIG. 3. However, on the other hand, when the friction coefficient of the smooth layer is too low, the catalyst carrier has a possibility of slipping off. Accordingly, the friction coefficient of the smooth layer is preferably from 0:1 to 0.5, and more preferably from 0.2 to 0.3. Incidentally, the friction coefficient can be measured in accordance with JIS 7125 "Plastic Film and Sheet-Friction Coefficient Test Method". Further, similarly to the viscoelastic layer, the smooth layer is required to have moderate tensile strength in terms of ease of the winding operation and being stretched in a circumferential direction when wound around the catalyst carrier. Furthermore, it is desirable to produce no harmful gas by heat at the time of working of the catalytic carrier.

Taking these into consideration, a smooth layer forming material is preferably a homopolymer or copolymer of acrylic acid, an acrylic ester, acrylamide, methacrylic acid, a methacrylic ester or the like, which is a thermoplastic resin containing no nitrile group in its molecule. Further, it is desirable that the glass transition point of these resins is from 25° C. to −40° C. When the glass transition point exceeds 25° C., the resin layer becomes hard, because the circumference temperature of the winding operation exceeds the glass transition temperature, resulting in a high possibility of generating cracks or breakage in the smooth layer and further in the viscoelastic layer at the time of winding. On the other hand, a glass transition temperature of −40° C. or less poses a problem for canning, because of high friction coefficient. Further, these resins are desirable to contain a crosslinking agent. When no crosslinking agent is contained, viscosity of the resins increases, so that the friction coefficient increases to pose a problem for canning.

Further, as a smooth layer forming material, a water-soluble organic polymer compound can also be used. Specific examples thereof include carboxymethyl cellulose, polyvinyl alcohol, polyacrylamide, polyethylene oxide and the like. These water-soluble polymers are insufficient in flexibility after drying in some cases when used alone, so that moderate flexibility can be obtained by adding a humectant such as glycerol.

These resins are each used alone or mixed to prepare a coating solution, and the coating solution is applied to the viscoelastic layer and dried to form the smooth layer. Further, it is also possible to form layers for respective resins and to laminate them. There is no restriction on a coating method, and examples thereof include brush coating, roll coating, spray coating, screen printing, ink-jet printing and the like.

Further, it is also possible to add an inorganic coating agent or the like for reinforcement. Examples thereof include an alkyl silicate, a silicone, amorphous silica, water glass, bentonite, mica, colloidal silica, colloidal alumina and the like.

In order to improve coating properties, it is also possible to add a viscosity modifier. Examples thereof include carboxymethyl cellulose, polyvinyl alcohol, bentonite, starch and the like.

In order to identify the smooth layer, it is also possible to previously add a dye or a pigment to the resin. Any conventional dye or pigment may be used, as long as it produces no harmful gas.

Different from the conventional protective layer, the smooth layer does not require strength which can withstand a stress occurring when wound around the catalyst carrier. It is therefore preferred that the thickness of the smooth layer is made as thin as possible in order to decrease the organic content, and it is desirably from 0.1 to 10% based on the thickness of the whole holding material.

Further, it is also possible to use a synthetic resin film as the smooth layer. Although a material therefor is not particularly restricted, one which produces no harmful gas by heat is desirable. Examples thereof include polyolefins such as polyethylene and polypropylene, general-purpose resins such as polyethylene terephthalate and polystyrene, biodegradable plastics such as polylactic acid and a succinic acid-based polymer, and the like. In order to decrease the organic content as described above, the thickness of this synthetic resin film is preferably 5 μm or less, and more preferably from 0.5 to 3.5 μm.

It is preferred that the organic content of the whole holding material is smaller. It is 5% by mass or less, preferably 2% by mass or less, and particularly preferably 1.5% by mass or less, based on the total amount of the holding material. Accordingly, in the substrate, the organic binder and the organic fibers require only maintaining a compressed state, and it is preferably 3% by mass or less, more preferably 2% by mass or less, and sill more preferably 1% by mass or less, based on the total weight of the holding material. Further, in the case of the above-mentioned thickness, the organic content in the viscoelastic layer is preferably 2.5 $g/m^2$ or less, more preferably 2.0 $g/m^2$ or less, still more preferably 1.5 $g/m^2$ or less, and particularly preferably 1.0 $g/m^2$ or less. Furthermore, the organic content in the smooth layer is the same as described above, and in the case of the above-mentioned thickness, it is preferably 2.5 $g/m^2$ or less, more preferably 2.0 $g/m^2$ or less, still more preferably 1.5 $g/m^2$ or less, and particularly preferably 1.0 $g/m^2$ or less.

In addition, the viscoelastic layer and the smooth layer are partially formed, thereby being able to decrease the organic content. However, when the covered area is too small, there is concern that the inorganic fibers of the substrate drop off from an uncovered portion, or that cracks occur at the time of winding. On the other hand, when the covered area is too large, the effect of decreasing the organic content is small. Therefore, the covered area is preferably from 30 to 90%, and more preferably from 40 to 60%, based on the one-sided surface area of the holding material. In the case of partial formation, since there is concern that cracks are formed in a circumferential direction of the catalyst carrier when the holding material is wound around the catalyst carrier, a covering pattern is desirably a lattice pattern, a stripe pattern extending in a longitudinal direction (corresponding to a circumferential direction of the catalyst carrier), or the like.

The holding material for a catalytic converter of the invention is wound around the catalyst carrier in such a manner that the viscoelastic layer or the smooth layer is placed outside (on the metal casing side). In winding, the substrate is protected by the viscoelastic layer or the smooth layer to be able to prevent cracks and breakage from occurring.

EXAMPLES

The invention will be described in more detail with reference to the following examples and comparative examples. However, the invention is not limited to those examples at all.

Example 1

An aqueous slurry containing 0.75 part by mass of fibrillated pulp as an organic binder, 3 parts by mass of colloidal silica as an inorganic binder and 10,000 parts by mass of water, based on 100 parts by mass of alumina fibers was prepared. This slurry was subjected to dehydration molding to obtain a wet mat. This mat was dried at 100° C. while compressing it to obtain a compressed mat substrate having a basis weight of 1,100 g/m$^2$ and an organic content of 0.75%.

A viscoelastic layer-forming agent obtained by adding 100 parts by mass of rosin as a tackifier to 100 parts by mass of styrene-butadiene rubber was applied to one surface of the resulting substrate in an amount of 0.5 g/m$^2$. Then, a polyethylene terephthalate film having a thickness of 1.8 mm (2.5 g/m$^2$) is laminated on the substrate coated with the viscoelastic layer-forming agent, and heated at 100° C. for 10 minutes to pressure bond the mat substrate to the film, thereby forming a smooth layer having a friction coefficient of 0.20 to obtain a laminated body having an organic content of the substrate of 0.75% by mass based on the total amount of the laminated body, an organic content of the viscoelastic layer of 0.05% by mass, an organic content of the smooth layer of 0.25% by mass and a total organic content of 1.05% by mass.

Further, for a sample piece obtained by heating the above-mentioned viscoelastic layer-forming agent at 100° C. for 10 minutes, the Young's modulus and the rate of elongation were measured and calculated in accordance with JIS K6251. As a result, the Young's modulus was 0.01 MPa, and the rate of elongation was 400%.

Example 2

A laminated body having an organic content of the substrate of 0% by mass, an organic content of the viscoelastic layer of 0.05% by mass, an organic content of the smooth layer of 0.25% by mass and a total organic content of 0.3% by mass was obtained in the same manner as in Example 1 with the exception that a blanket having a basis weight of 1,100 g/m$^2$ and an organic content of 0% obtained by forming collected mullite fibers into a mat shape by needling was used as the substrate.

Example 3

A crosslinking agent-free acrylic resin having a glass transition point of −30° C. was applied as a viscoelastic layer-forming agent in an amount of 1 g/m$^2$ to one surface of a compressed mat substrate prepared in the same manner as in Example 1, and dried at 105° C. to obtain a viscoelastic layer. Further, a crosslinking agent-containing acrylic resin having a glass transition temperature of −5° C. was applied in an amount of 2 g/m$^2$ onto the viscoelastic layer, and dried at 105° C. to form a smooth layer having a friction coefficient of 0.30, thereby obtaining a laminated body having an organic content of the substrate of 0.75% by mass, an organic content of the viscoelastic layer of 0.1% by mass, an organic content of the smooth layer of 0.2% by mass and a total organic content of 1.05% by mass.

Further, for a sample piece obtained by heating the above-mentioned viscoelastic layer-forming agent at 105° C., the Young's modulus and the rate of elongation were measured and calculated in accordance with JIS K6251. As a result, the Young's modulus was 0.005 MPa, and the rate of elongation was 450%.

Comparative Example 1

An ethylene-vinyl acetate adhesive having a glass transition point of 50° C. was applied in an amount of 0.5 g/m$^2$ to one surface of a compressed mat substrate prepared in the same manner as in Example 1, and the same polyethylene terephthalate film as used in Example 1 was laminated thereon. Then, the compressed mat and the film were adhered to each other through a heat roller of 100° C. to obtain a laminated body having a total organic content of 1.05% by mass.

Further, for the resin used in the above-mentioned adhesive, the Young's modulus and the rate of elongation were measured and calculated in accordance with JIS K6251. As a result, the Young's modulus was 1.1 MPa, and the rate of elongation was 50%.

An aqueous slurry containing 10 parts of an acrylic resin as an organic binder and 10,000 parts of water, based on 100 parts of alumina fibers was prepared. This slurry was subjected to dehydration molding to obtain a wet mat. This mat was dried at 100° C. while compressing it to obtain a compressed mat substrate having a basis weight of 1,100 g/m$^2$ and an organic content of 10% by mass.

Winding Test

Test specimens obtained by cutting out from the laminated bodies of Examples 1 to 3 and Comparative Example 1 were each wound around a cordierite catalyst carrier of a cylindrical honeycomb structure having a diameter of 80 mm and a length of 100 mm to obtain a wound body comprising the catalyst carrier and the holding material. For Comparative Example 2, the substrate was cut out to form a test specimen, and a similar wound body was obtained. In winding, the test specimens of Examples 1 to 3 and Comparative Example 1 were each wound in such a manner that the smooth layer was placed outside. For the test specimens of Examples 1 to 3 and Comparative Example 2, no trouble such as fractures occurred in the smooth layer or a surface of the substrate, and winding was possible without problems. However, the test specimen of Comparative Example 1 was folded along an axial direction of the catalyst carrier when the test specimen was wound around the catalyst carrier, the film tore at a folded place, and cracks occurred also in the substrate. This is likely because a periphery of the test specimen was pulled in winding, and the viscoelastic layer failed to follow a stress occurring thereby, resulting in concentration of stress to one point to cause development of the cracks therefrom in the smooth layer. Further, in Examples 1 to 3, it is deduced that even when the periphery of the test specimen was pulled in winding, the viscoelastic layer expanded to disperse the stress, thereby being able to perform winding without the occurrence of fractures in the smooth layer.

Mounting Test

The wound bodies of Examples 1 to 3 and Comparative Example 1 having no problem in the above-mentioned winding test were each mounted in a stainless steel casing to prepare a catalytic converter. Then, each catalytic converter prepared was connected to an exhaust pipe of a gasoline engine, and exhaust gas was allowed to pass therethrough. During passage of the exhaust gas, a gas discharged from each catalytic converter was analyzed.

In the catalytic converter fitted with the wound body of Comparative Example 2, an organic gas assumed to be derived from the organic binder was detected immediately after passage of the exhaust gas, and the $CO_2$ concentration and the CO concentration were also significantly high compared to the catalytic converters fitted with the wound bodies of Examples 1 to 3. Further, the passage of the exhaust gas was continued. As a result, the catalytic converters fitted with the wound bodies of Examples 1 to 3 showed a stable purifying function, and sealing performance thereof was also excellent. In contrast, in the catalytic converter fitted with the wound body of Comparative Example 2, the $CO_2$ concentration and the CO concentration decreased with an elapse of time, and after an elapse of a certain period of time, it showed a stable purifying function approximately equivalent to that of the catalytic converters fitted with the wound bodies of Examples 1 to 3.

Further, in order to confirm characteristics of the invention, the following tests A and B were performed.

Test A

In order to clarify the relationship between the Young's modulus and rate of elongation of the viscoelastic layer and the winding properties, the above-mentioned winding test was performed by using test specimens having a desired size and shape obtained by cutting out from the laminated bodies prepared in Reference Examples 1 to 8 as described below. Although the results thereof are shown in Table 1, it is revealed that when the Young's modulus at 25° C. of the viscoelastic layer is 0.3 MPa or less, there is no problem for winding the test specimen around the catalyst carrier. Further, it is revealed that when the rate of elongation is 300% or more, winding is improved.

Reference Example 1

An aqueous slurry containing 1.0 part of an acrylic resin as an organic binder, 3 parts of colloidal silica as an inorganic binder and 10,000 parts of water, based on 100 parts of alumina fibers was prepared. This slurry was subjected to dehydration molding to obtain a wet mat. This mat was dried at 100° C. while compressing it to obtain a compressed mat substrate having a basis weight of 1,100 g/m$^2$ and an organic content of 1.0%. The viscoelastic layer-forming agent used in Example 3 was applied to one surface of the resulting substrate in an amount of 2.0 g/m$^2$, and then, dried at 105° C. to obtain a laminated body of the substrate and the viscoelastic layer.

Further, for a sample piece obtained by drying the above-mentioned viscoelastic layer-forming agent at 105° C., the Young's modulus and the rate of elongation were measured and calculated in accordance with JIS K6251. As a result, the Young's modulus was 0.01 MPa, and the rate of elongation was 500%.

Reference Example 2

A crosslinking agent-containing acrylic resin having a glass transition point of 0° C. was applied as a viscoelastic layer-forming agent in an amount of 2.0 g/m$^2$ to one surface of a compressed mat substrate prepared in the same manner as in Reference Example 1, and dried at 105° C. to obtain a laminated body of the substrate and the viscoelastic layer. Here, for a sample piece obtained by drying the above-mentioned viscoelastic layer-forming agent at 105° C., the Young's modulus and the rate of elongation were measured and calculated in accordance with JIS K6251. As a result, the Young's modulus was 0.1 MPa, and the rate of elongation was 350%.

Reference Example 3

A crosslinking agent-containing acrylic resin having a glass transition point of −15° C. was applied as a viscoelastic layer-forming agent in an amount of 2.0 g/m$^2$ to one surface of a compressed mat substrate prepared in the same manner as in Reference Example 1, and dried at 105° C. to obtain a laminated body of the substrate and the viscoelastic layer. Here, for a sample piece obtained by drying the above-mentioned viscoelastic layer-forming agent at 105° C., the Young's modulus and the rate of elongation were measured and calculated in accordance with JIS K6251. As a result, the Young's modulus was 0.2 MPa, and the rate of elongation was 350%.

Reference Example 4

The viscoelastic layer-forming agent used in Reference Example 2 was applied in an amount of 2.0 g/m$^2$ to one surface of a compressed mat substrate prepared in the same manner as in Reference Example 1, and dried at 130° C. to obtain a laminated body of the substrate and the viscoelastic layer. Here, for a sample piece obtained by drying the above-mentioned viscoelastic layer-forming agent at 130° C., the Young's modulus and the rate of elongation were measured and calculated in accordance with JIS K6251.

As a result, the Young's modulus was 0.25 MPa, and the rate of elongation was 200%.

Reference Example 5

The viscoelastic layer-forming agent used in Reference Example 3 was applied in an amount of 2.0 g/m$^2$ to one surface of a compressed mat substrate prepared in the same manner as in Reference Example 1, and dried at 130° C. to obtain a laminated body of the substrate and the viscoelastic layer. Here, for a sample piece obtained by drying the above-mentioned viscoelastic layer-forming agent at 130° C., the Young's modulus and the rate of elongation were measured and calculated in accordance with JIS K6251.

As a result, the Young's modulus was 0.27 MPa, and the rate of elongation was 310%.

Reference Example 6

The viscoelastic layer-forming agent used in Reference Example 3 was applied in an amount of 2.0 g/m$^2$ to one surface of a compressed mat substrate prepared in the same manner as in Reference Example 1, and dried at 170° C. to obtain a laminated body of the substrate and the viscoelastic layer. Here, for a sample piece obtained by drying the above-mentioned viscoelastic layer-forming agent at 170° C., the Young's modulus and the rate of elongation were measured and calculated in accordance with JIS K6251.

As a result, the Young's modulus was 0.4 MPa, and the rate of elongation was 280%.

Reference Example 7

A crosslinking agent-containing acrylic resin having a glass transition point of −30° C. was applied as a viscoelastic layer-forming agent in an amount of 2.0 g/m$^2$ to one surface of a compressed mat substrate prepared in the same manner as in Reference Example 1, and dried at 130° C. to obtain a laminated body of the substrate and the viscoelastic layer. Here, for a sample piece obtained by drying the above-mentioned viscoelastic layer-forming agent at 130° C., the Young's modulus and the rate of elongation were measured and calculated in accordance with JIS K6251. As a result, the Young's modulus was 0.45 MPa, and the rate of elongation was 175%.

Reference Example 8

The viscoelastic layer-forming agent used in Reference Example 7 was applied in an amount of 2.0 g/m$^2$ to one surface of a compressed mat substrate prepared in the same manner as in Reference Example 1, and dried at 170° C. to obtain a laminated body of the substrate and the viscoelastic layer. Here, for a sample piece obtained by drying the above-mentioned viscoelastic layer-forming agent at 170° C., the Young's modulus and the rate of elongation were measured and calculated in accordance with JIS K6251. As a result, the Young's modulus was 0.6 MPa, and the rate of elongation was 150%.

Reference Example 9

The viscoelastic layer-forming agent used in Example 3 was applied in an amount of 1.0 g/m$^2$ to one surface of a compressed mat substrate prepared in the same manner as in Example 1. Then, a polyethylene terephthalate film having a thickness of 5.0 μm (5.0 g/m$^2$) is laminated on the substrate coated with the viscoelastic layer-forming agent, and heated at 105° C. for 10 minutes to adhere the mat substrate to the film, thereby forming a smooth layer having a friction coefficient of 0.20 to obtain a laminated body having an organic content of the substrate of 0.75% by mass, an organic content of the viscoelastic layer of 0.1% by mass, an organic content of the smooth layer of 0.5% by mass and a total organic content of 1.35% by mass.

Reference Example 10

The viscoelastic layer-forming agent used in Example 3 was applied in an amount of 5.0 g/m$^2$ to one surface of a compressed mat substrate prepared in the same manner as in Reference Example 1. Then, a polyethylene terephthalate film having a thickness of 5.0 μm (5.0 g/m$^2$) is laminated on the substrate coated with the viscoelastic layer-forming agent, and heated at 105° C. for 10 minutes to adhere the mat substrate to the film, thereby forming a smooth layer having a friction coefficient of 0.20 to obtain a laminated body having an organic content of the substrate of 1.0% by mass, an organic content of the viscoelastic layer of 0.5% by mass, an organic content of the smooth layer of 0.5% by mass and a total organic content of 2.0% by mass.

Reference Example 11

The viscoelastic layer-forming agent used in Example 3 was applied in an amount of 5.0 g/m$^2$ to one surface of a compressed mat substrate prepared in the same manner as in Reference Example 1. Then, a polyethylene terephthalate film having a thickness of 30 μm (30 g/m$^2$) is laminated on the substrate coated with the viscoelastic layer-forming agent, and heated at 105° C. for 10 minutes to adhere the mat substrate to the film, thereby forming a smooth layer having a friction coefficient of 0.20 to obtain a laminated body having an organic content of the substrate of 1.0% by mass, an organic content of the viscoelastic layer of 0.5% by mass, an organic content of the smooth layer of 3.0% by mass and a total organic content of 4.5% by mass.

TABLE 1

| | Reference Example 1 | Reference Example 2 | Reference Example 3 | Reference Example 4 | Reference Example 5 | Reference Example 6 | Reference Example 7 | Reference Example 8 |
|---|---|---|---|---|---|---|---|---|
| Young's Modulus (MPa) | 0.01 | 0.1 | 0.2 | 0.25 | 0.27 | 0.4 | 0.45 | 0.6 |
| Rate of Elongation (%) | 500 | 350 | 350 | 200 | 310 | 280 | 175 | 150 |
| Results of Winding Test | Good | Good | Good | Fair | Good | Poor | Poor | Poor |

Good: Winding could be performed without the occurrence of cracks in the viscoelastic layer.
Fair: Although minute fractures occurred in the viscoelastic layer, winding could be performed.
Poor: The viscoelastic layer tore, and cracks occurred also in the substrate.

Test B

In order to clarify the relationship between the total resin amount of the holding material and the amount of gas generated, the ignition loss of the test specimens prepared in Examples 1 and 2, Comparative Example 2 and the following Reference Examples 9 to 11 was measured in accordance with JIS K0067. In the measurement of the ignition loss, the test specimens was used immediately after standing at 105° C. for 8 hours in a drier for removing water contained in the test specimens. Although the results thereof are shown in Table 2, it is revealed that the smaller amount of total organic components contained in the test specimen results in the smaller ignition loss. The generated gas is caused by organic components contained in the holding material, so that it is deduced that the smaller amount of total organic components results in the smaller amount of generated gas. In the holding material, it is preferred that the amount of generated gas is smaller. However, a certain amount of organic components is required for acting as the holding material, but the amount thereof cannot be clearly defined. From the viewpoint of decreasing the generated gas, the total organic content is 5% by mass or less, preferably 2% by mass or less, and more preferably 1.5% by mass or less.

TABLE 2

| Organic Content (% by mass) | Example 2 | Example 1 | Reference Example 9 | Reference Example 10 | Reference Example 11 | Comparative Example 2 |
|---|---|---|---|---|---|---|
| Substrate | 0 | 0.75 | 0.75 | 1.0 | 1.0 | 10.0 |
| Viscoelastic Layer | 0.05 | 0.05 | 0.1 | 0.5 | 0.5 | 0.0 |
| Smooth Layer | 0.25 | 0.25 | 0.5 | 0.5 | 3.0 | 0.0 |
| Total | 0.3 | 1.05 | 1.35 | 2.0 | 4.5 | 10.0 |
| Ignition Loss*1) | 3.5 | 10 | 13 | 18 | 41 | 100 |

*1)Relative values taking Comparative Example 2 as 100

What is claimed is:

1. A catalytic converter comprising a catalyst carrier, a metal casing for receiving the catalyst carrier, and a holding material interposed in a gap between the catalyst carrier and the metal casing, wherein the holding material comprises an inorganic fiber substrate, a viscoelastic layer comprising at least one of (A) a rubber to which a tackifier is added and (B) a resin having a glass transition point of 25° C. or less , the viscoelastic layer having a Young's modulus at 25° C. of 0.3 MPa or less and being formed at least on a casing side surface of the inorganic fiber substrate, and a smooth layer formed on a surface of the viscoelastic layer and having a friction coefficient of 0.1 to 0.5.

2. The catalytic converter according to claim 1, wherein the viscoelastic layer contains organic components in an amount of 2.5 g/m$^2$ or less per unit area of the substrate of the holding material.

3. The catalytic converter according to claim 1, wherein the smooth layer contains organic components in an amount of 2.5 g/m$^2$ or less per unit area of the substrate of the holding material.

4. The catalytic converter according to claim 1, wherein the smooth layer is a synthetic resin film having a thickness of 5 μAM or less.

5. The catalytic converter according to claim , wherein the total organic content is 1.5% or less by mass based on the total mass of the holding material.

6. A catalytic converter comprising a catalyst carrier, a metal casing for receiving the catalyst carrier, and a holding material interposed in a gap between the catalyst carrier and the metal casing, wherein the holding material comprises an inorganic fiber substrate and a viscoelastic layer comprising at least one of (A) a rubber to which a tackifier is added and (B) a resin having a glass transition point of 25° C. or less , the viscoelastic layer containing organic components in an amount of 2.5 g/m$^2$ or less per unit area of the substrate of the holding material and having a Young's modulus at 25° C. of 0.3 MPa or less and being formed at least on a casing side surface of the inorganic fiber substrate.

7. The catalytic converter according to claim 6, wherein the total organic content is 1.5% or less by mass based on the total mass of the holding material.

* * * * *